US010357679B1

(12) United States Patent
Volk

(10) Patent No.: US 10,357,679 B1
(45) Date of Patent: Jul. 23, 2019

(54) WALL-MOUNTABLE EXERCISE APPARATUS

(71) Applicant: Seymour Volk, Belle Fourche, SD (US)

(72) Inventor: Seymour Volk, Belle Fourche, SD (US)

( * ) Notice: Subject to any disclaimer, the term of this patent is extended or adjusted under 35 U.S.C. 154(b) by 328 days.

(21) Appl. No.: 15/420,535

(22) Filed: Jan. 31, 2017

(51) Int. Cl.
*A63B 21/00* (2006.01)
*A63B 21/04* (2006.01)
*A63B 21/055* (2006.01)

(52) U.S. Cl.
CPC ..... *A63B 21/0442* (2013.01); *A63B 21/0555* (2013.01); *A63B 21/0557* (2013.01); *A63B 21/4047* (2015.10)

(58) Field of Classification Search
CPC ..... A63B 21/0058; A63B 21/00061; A63B 21/00065; A63B 21/00069; A63B 21/00072; A63B 21/00076; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/0615; A63B 21/0616; A63B 21/0617; A63B 21/065; A63B 21/068; A63B 21/08; A63B 21/15; A63B 21/152; A63B 21/159; A63B 21/16; A63B 21/1609; A63B 21/1618; A63B 21/1627; A63B 21/1636; A63B 21/1645; A63B 21/1654; A63B 21/1663; A63B 21/1681; A63B 21/169; A63B 21/4001; A63B 21/4023; A63B 21/4027; A63B 21/4029; A63B 21/4031; A63B 21/4033; A63B 21/4035; A63B 21/4045; A63B 21/4047; A63B 21/4049; A63B 2210/00; A63B 2210/50; A63B 2225/09; A63B 2225/093
See application file for complete search history.

(56) References Cited

U.S. PATENT DOCUMENTS

D182,660 S 4/1958 Hastings
3,013,799 A * 12/1961 Wise ..... A63B 21/015 482/118
3,403,675 A * 10/1968 Carr ..... A61H 1/0229 602/32
3,633,907 A * 1/1972 Cane ..... A63B 21/055 482/123
4,557,480 A * 12/1985 Dudley ..... A63B 21/018 482/120
4,592,545 A * 6/1986 Sagedahl ..... A63B 21/0058 473/229
4,611,805 A * 9/1986 Franklin ..... A63B 21/04 482/129

(Continued)

FOREIGN PATENT DOCUMENTS

EP 2292302 A1 3/2011

*Primary Examiner* — Gary D Urbiel Goldner
(74) *Attorney, Agent, or Firm* — Kyle A. Fletcher, Esq.

(57) ABSTRACT

The wall-mountable exercise apparatus is an exercise machine that is particularly well suited for physical therapy and resistance training. It occupies no floor space when not in use, is easily set up, is adjustable for pulling at a wide variety of heights and angles, and supports replaceable resistance bands of various tensions.

14 Claims, 5 Drawing Sheets

(56) References Cited

U.S. PATENT DOCUMENTS 4,763,897 A * 8/1988 Yakata ..... A63B 21/06 482/100
5,160,305 A * 11/1992 Lin ..... A63B 23/00 482/138
5,468,205 A * 11/1995 McFall ..... A63B 21/0552 482/121
5,601,518 A * 2/1997 Weintraub ..... A63B 21/00072 482/129
5,681,225 A * 10/1997 Cary ..... A63B 21/0552 119/792
5,820,529 A * 10/1998 Weintraub ..... A63B 21/0552 482/92
6,228,004 B1 * 5/2001 Steinbach ..... A63B 21/023 482/121
6,267,711 B1 7/2001 Hinds
6,443,877 B1 * 9/2002 Hoecht ..... A63B 23/035 482/103
6,482,139 B1 * 11/2002 Haag ..... A63B 21/0552 482/121
7,018,323 B1 * 3/2006 Reynolds ..... A63B 7/04 482/112
D586,410 S * 2/2009 Citterio ..... D21/673
7,601,105 B1 * 10/2009 Gipson, III ..... A63B 21/055 482/103
7,608,024 B2 * 10/2009 Sechrest ..... A63B 21/154 482/103
7,625,325 B1 12/2009 Yost
7,819,787 B2 * 10/2010 Kassel ..... A63B 21/00043 24/300
7,976,445 B2 * 7/2011 Lalaoua ..... A63B 21/4005 482/121
9,050,493 B2 6/2015 Perez
2003/0109321 A1 * 6/2003 Novotny ..... A63B 21/4017 473/219
2003/0109324 A1 * 6/2003 Novotny ..... A63B 21/4017 473/257
2003/0176261 A1 * 9/2003 Simonson ..... A63B 21/152 482/103
2004/0229708 A9 * 11/2004 Novotny ..... A63B 21/169 473/257
2005/0148437 A1 * 7/2005 Ryan ..... A63B 21/018 482/37
2006/0040813 A1 2/2006 Murphy
2007/0054785 A1 * 3/2007 Drechsler ..... A63B 21/078 482/94
2007/0161472 A1 * 7/2007 Drechsler ..... A63B 15/00 482/100
2008/0300116 A1 * 12/2008 Eder ..... A63B 21/156 482/100
2010/0167885 A1 * 7/2010 Kassel ..... A63B 21/00043 482/121
2010/0292056 A1 * 11/2010 Birch ..... A63B 21/00185 482/129
2011/0237410 A1 9/2011 Perez
2013/0212857 A1 8/2013 Donofrio
2013/0303346 A1 * 11/2013 Barker ..... A63B 21/018 482/129
2016/0193495 A1 * 7/2016 Nelson ..... A63B 21/159 600/595
2017/0056702 A1 * 3/2017 Carter ..... A63B 21/0442

* cited by examiner

WALL-MOUNTABLE EXERCISE APPARATUS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of exercise equipment, more specifically, a wall-mounted physical therapy station with easily adjusted angles and replaceable resistance bands.

Physical therapists often use resistance bands to help their clients recover from injuries and illnesses. Resistance bands are available in a variety of tensions so the therapist can select a tension that is appropriate for the specific clients and specific injury. Resistance bands can be used in exercises to strength many different parts of the body. As non-limiting example, resistance bands can be incorporated into exercise routines to strengthen ankles, knees, hips, lower back, upper back, elbows, neck, and shoulders. Some physical therapy exercises involve securing one end of a resistance band to an immovable object, often a heavy exercise machine that happens to be nearby but otherwise has not role in the specific exercise being performed, and then pulling repeatedly on the other end of the resistance band using some part of the client's body. Depending upon the specific exercise, the point of attachment to the immovable object may be low (at ankle or knee level), high (at head height or above), or somewhere in between.

SUMMARY OF INVENTION

The wall-mountable exercise apparatus is an exercise machine that is particularly well suited for physical therapy and resistance training. It occupies no floor space when not in use, is easily set up, is adjustable for pulling at a wide variety of heights and angles, and supports replaceable resistance bands of various tensions.

An object of the invention is to provide an exercise machine that secures to a wall and therefore takes up no floor space when not in use.

A further object of the invention is to provide an exercise machine that provides point of attachment for resistance bands wherein the point of attachment can be easily adjusted from a low height to a high height and multiple height in between.

Yet another object of the invention is to provide an exercise machine that allows easy replacement of resistance bands with new resistance bands and resistance bands having alternative tensions.

These together with additional objects, features and advantages of the wall-mountable exercise apparatus will be readily apparent to those of ordinary skill in the art upon reading the following detailed description of the presently preferred, but nonetheless illustrative, embodiments when taken in conjunction with the accompanying drawings.

In this respect, before explaining the current embodiments of the wall-mountable exercise apparatus in detail, it is to be understood that the wall-mountable exercise apparatus is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wall-mountable exercise apparatus.

It is therefore important that the claims be regarded as including such equivalent construction insofar as they do not depart from the spirit and scope of the wall-mountable exercise apparatus. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. Throughout this document any reference to the usage of a bolt includes the usage of one or more nuts, flat washers, star washers, cotter pins, captive hardware, or other hardware ordinarily associated with the use of a bolt and appropriate for the embodiment whether explicitly stated or not. As used herein the word "or" is intended to be inclusive.

Figure 1:
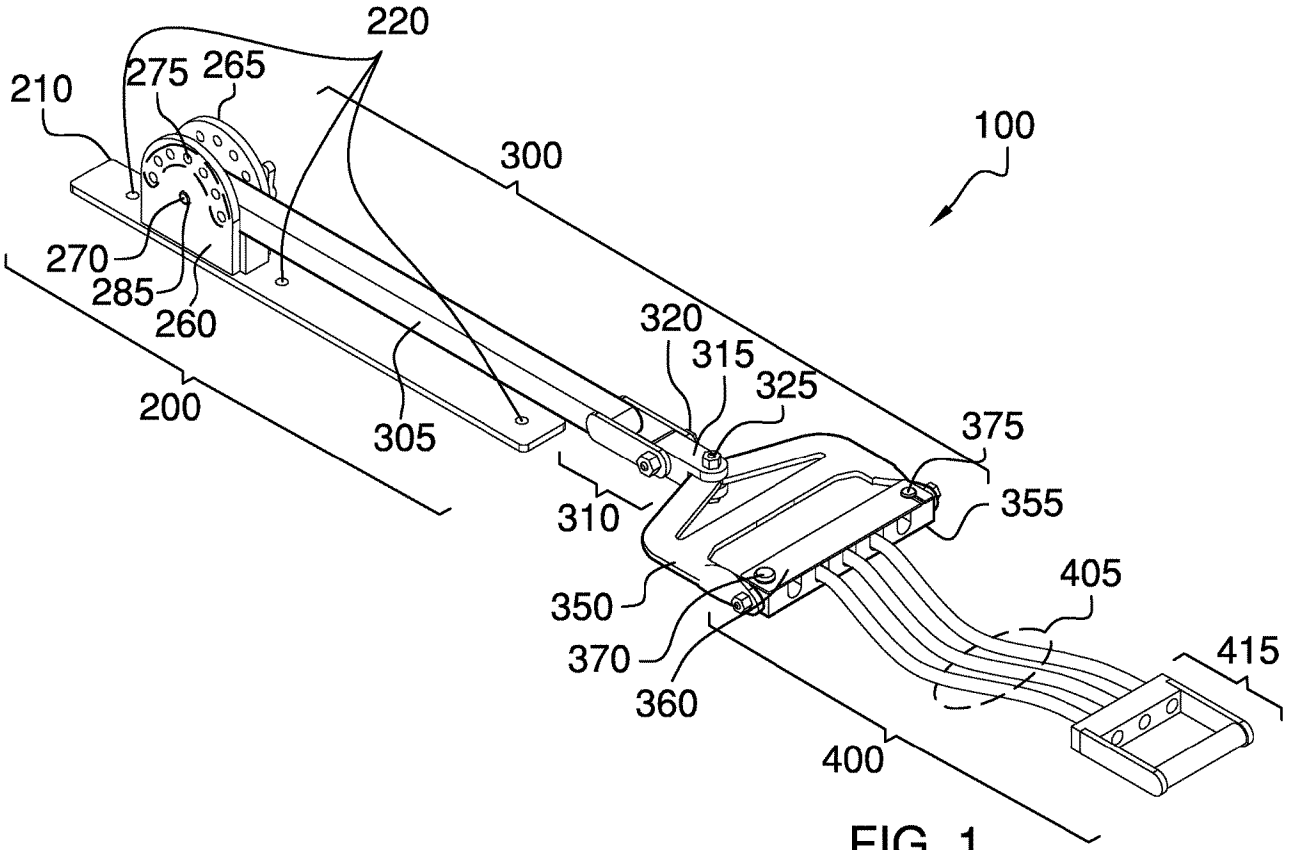
FIG. 1 is a perspective view of an embodiment of the disclosure.
Figure 2:
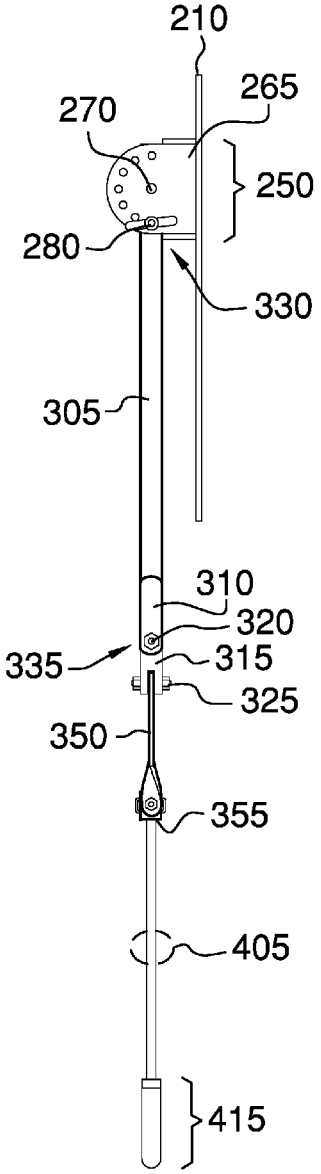
FIG. 2 is a side view of an embodiment of the disclosure.
Figure 3:
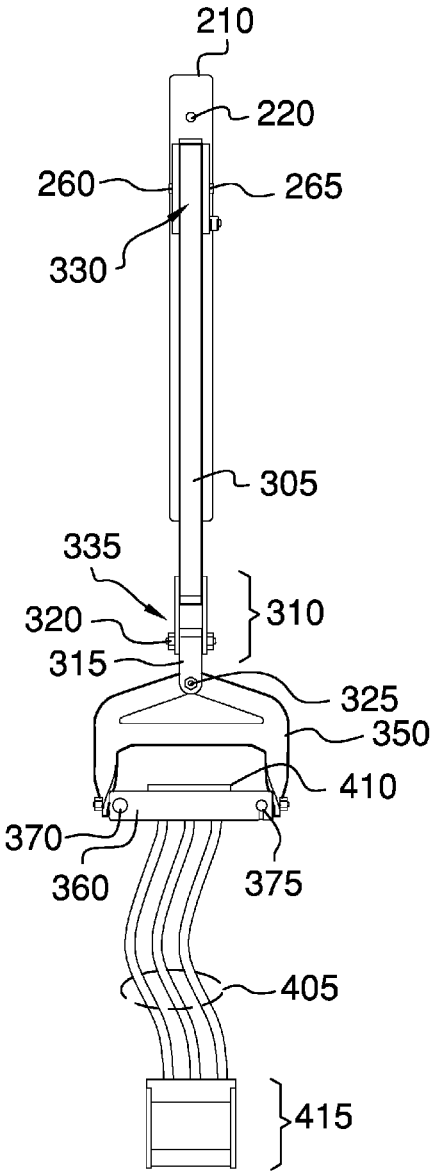
FIG. 3 is a front view of an embodiment of the disclosure.
Figure 4:
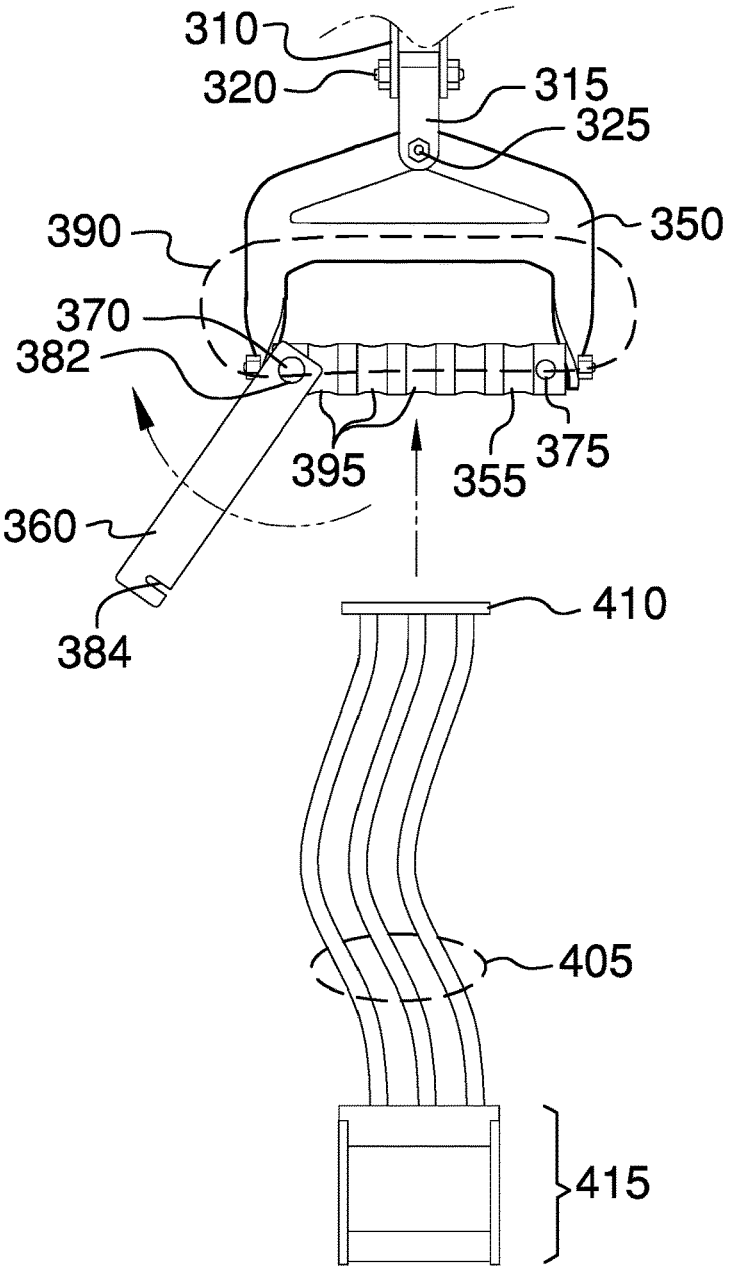
FIG. 4 is a detail view of an embodiment of the disclosure illustrating the installation of a client interface subassembly.
Figure 5:
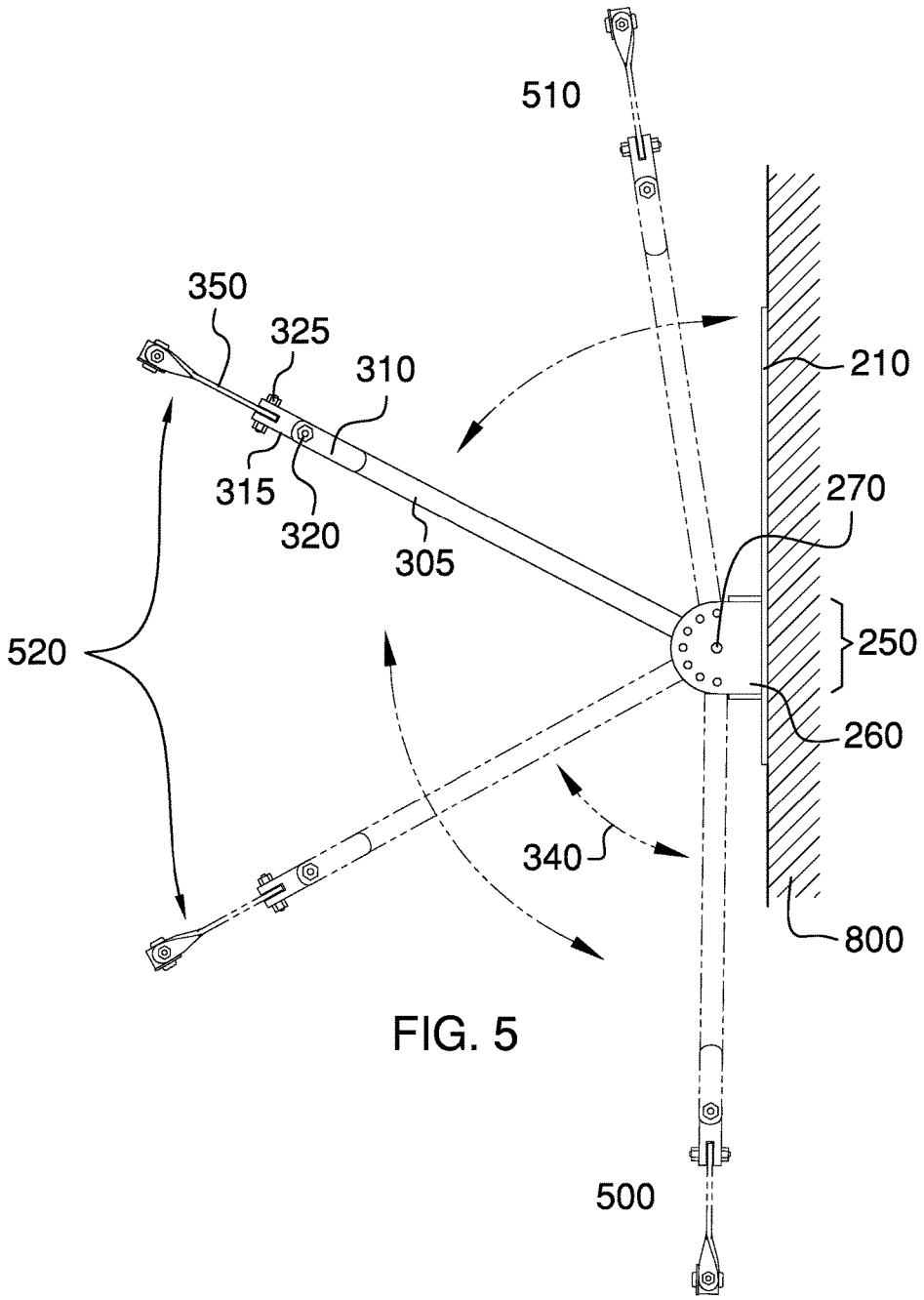
FIG. 5 is a side view of an embodiment of the disclosure illustrating various arm angles.
Figure 6A:
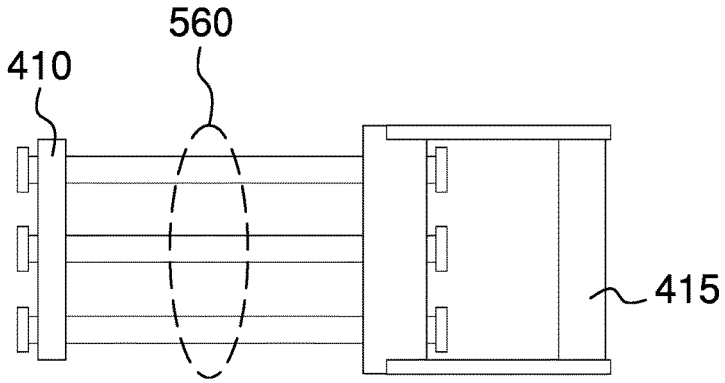
FIG. 6A is a detail view of an embodiment of the disclosure illustrating the use of three separate resistance bands.
Figure 6B:
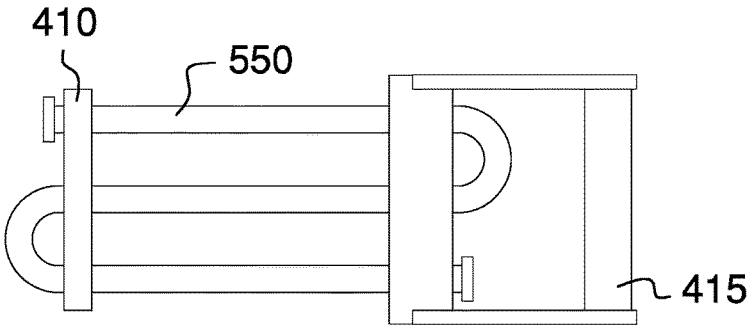
FIG. 6B is a detail view of an embodiment of the disclosure illustrating the use of one single resistance band with band ends attached at both the band terminator and the client interface.
Figure 6C:
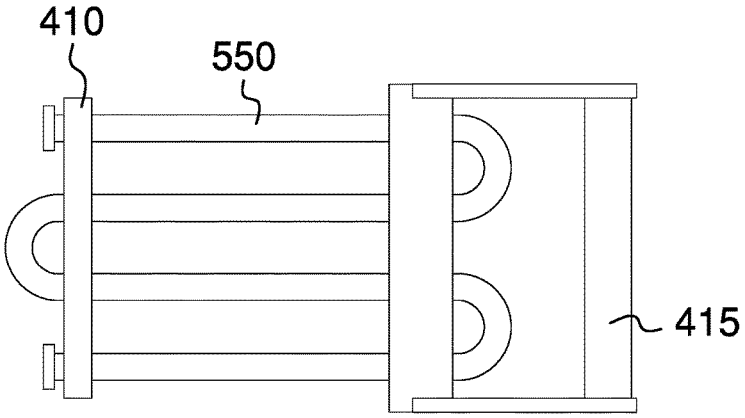
FIG. 6C is a detail view of an embodiment of the disclosure illustrating the use of one single resistance band with band ends attached at the band terminator.

Detailed reference will now be made to a first potential embodiment of the disclosure, which is illustrated in FIGS. 1 through 6C.

The wall-mountable exercise apparatus 100 (hereinafter invention) comprises a mounting subassembly 200, a pivot arm subassembly 300, and a client attachment subassembly 400. The mounting subassembly attaches to a wall 800 and provides an immovable anchor point for the exercises. The pivot arm subassembly 300 attaches by a first end 330 to the mounting subassembly 200 and by a second end 335 to the client interface subassembly 400. An angle adjustment subassembly 250 of the mounting subassembly 200 allows the pivot arm subassembly 300 to project from the mounting subassembly 200 at an arm angle 340 which will place the second end 335 of the pivot arm subassembly 300 at a low height 500, a high height 510, or at one or more heights between low and high 520.

The mounting subassembly 200 comprises a base plate 210 and the angle adjustment subassembly 250. The base plate 210 may be a substantially flat and rectangular element intended to mount to the wall 800. The base plate may have two or more mounting holes 220 through which fasteners may be passed to secure the base plate 210 to the wall 800. The angle adjustment subassembly 250 may be attached to a flat surface on the base plate 210 between the two or more mounting holes 220. The angle adjustment subassembly comprises a first side plate 260, a second side plate 265, and a pivot axis 270. The first side plate 260 and the second side plate 265 are permanently attached to the base plate 210 and are parallel to each other. The first side plate 260 is separated from the second side plate 265 by a distance at least as wide as an arm 305 of the pivot arm subassembly 300.

A central hole 285 in the first side plate 260 allows the pivot axis 270 to pass through the first side plate 260. A hole pattern 275 in the first side plate 260 forms a semicircle near an edge of the first side plate. The central hole 285 and the hole pattern 275 that appear on the first side plate 260 also appear on the second side plate 265 but are not referenced in the drawings. The pivot axis 270 passes through the central hole 285 of both the first side plate 260 and the second side plate 265 and through the first end 330 of the arm 305. The pivot axis 270 is secured in placed between the first side plate 260 and the second side plate 265 by additional hardware not references in the drawings. An alignment hole (not visible in the figures) in the arm 305 lines up with portions of the hole pattern 275 on both the first side plate 260 and the second side plate 265 when the arm 305 is moved to the arm angle 340 corresponding to a hole in the hole pattern 275. When the arm 305 is properly aligned, a locking pin 280 can be inserted into the first side plate 260 or the second side plate 265 and will pass through the arm 305 via the alignment hole and the second side plate 265 or the first side plate 260. The locking pin 280 will retained the arm 305 at the arm angle 340 as long as the locking pin 280 is left in place. In some embodiments, the locking pin 280 may be a T-handle, quick release pin.

The pivot arm subassembly 300 comprises the arm 305, a fork 310, a yoke 315, a swivel frame 350, a resistance band block 355, and a retainer plate 360. The arm 305 connects at the first end 330 of the pivot arm subassembly 300 to the mounting subassembly 200 via the pivot axis 270 as has been previously described. The end of the arm 305 that is not attached to the pivot axis 270 forms the fork 310. The fork 310 pivotally connects to the yoke 315 and the connection between the fork 310 and the yoke 315 is held together by and allowed to pivot around a first yoke bolt 320. The swivel frame 350 pivotally connects to the other side of the yoke 315 and connection between the yoke 315 and the swivel frame 350 is held together by and allowed to pivot around a second yoke bolt 325. The first yoke bolt 320 and the second yoke bolt 325 are oriented perpendicular to each other so that the swivel frame 350 may pivot both up and down and side to side with respect to the arm 305.

The swivel frame 350 comprises a C-shaped portion 390 and the resistance band block 355 mounts to the swivel frame 350 within the C-shaped portion 390 of the swivel frame 350. The resistance band block 355 is a rectangular block that has indentations 395 to accommodate one or more resistance bands 405. The retainer plate 360 fastens to the side of the resistance band block 355 on the side of the resistance band block 355 where the indentations 395 exist and the retainer plate 360 prevents the one or more resistance bands 405 from lifting out of the indentations 395.

The retainer plate 360 comprises a circular hole 382 on one end and a slotted hole 384 on the other end. The retainer plate 360 is held in place on the resistance band block 355 by a first knob screw 370 and a second knob screw 375. The first knob screw 370 passes through the circular hole 382 and into a hole (not shown) on the resistance band block 355. The second knob screw 375 passes through the slotted hole 384 and into a hole (not shown) on the resistance band block 355. To remove or replace the one or more resistance bands 405, both the first knob screw 370 and the second knob screw 375 are loosened but not necessarily removed. The retainer plate 360 may then pivot around the circular hole 382 and the first knob screw 370 until the slotted hole 384 becomes free of the second knob screw 375 and the retainer plate 360 can be pivoted out of the way to remove and replace the one or more resistance bands 405. The retainer plate 360 may then be pivoted back into a position where the slotted hole 384 engages the second knob screw 375 and then both the first knob screw 370 and the second knob screw 375 may be tightened against the resistance band block 355.

The client interface subassembly 400 comprises a client interface 415, the one or more resistance bands 405, and a band terminator 410.

The client interface 415 is the point of contact between the wall-mountable exercise apparatus and the client who is performing the exercise. Various forms of the client interface 415 may be used, depending upon the part of the client's body that is being exercised. As non-limiting examples, the client interface 415 may exist in the form of headbands, ankle cuffs, or hand grips. Only a hand grip form of the client interface 415 is illustrated in the figures.

The one or more resistance bands 405 comprise cords or tubes made from a stretchable material. Non-limiting examples of stretchable material that made be appropriate for use as resistance bands include latex, neoprene, and elastic. The one or more resistance bands 405 may comprise different colors to indicate the amount of tension required to stretch the one or more resistance bands 405 by a given distance. The one or more resistance bands are connected between the client interface 415 and the band terminator 410. In some embodiments the one or more resistance bands 405 may comprise one single resistance band 550 looped back and forth between the client interface 415 and the band terminator 410 and replaceable as a single component. In some embodiments the one or more resistance bands 405 may comprise multiple individual resistance bands 560, each attached at one end to the client interface 415 and at the other end to the band terminator 410 and each of the multiple individual resistance bands 560 individually replaceable. In some embodiments, the one or more resistance bands 405 may be permanently attached to the client interface 415 and to the band terminator 410 and the client interface subassembly 400 may be disposed of and replaced when the one or more resistance bands 405 show signs of substantial wear.

The band terminator comprises an endpoint for the one or more resistance bands 405 and facilitates attachment of the client interface subassembly 400 to the resistance band block 355. In embodiments where the one or more resistance bands 405 comprise multiple individual resistance bands 560 the band terminator 410 serves as an attachment point for one end of each of the multiple individual resistance bands 560, with the other endpoint for each band being the client interface 415. In embodiments where the one or more resistance bands 405 comprise the one single resistance band 550 looping back and forth between the band terminator 410 and the client interface 415, the band terminator 410 serves as an attachment point for one or both ends of the one single resistance band 550 and as a looping point for intermediate loops of the resistance band.

The band terminator 410 facilitates attachment of the client interface subassembly 400 to the resistance band block 355 by providing an organizing element for the one or more resistance bands 405. Once the retainer plate 360 has been pivoted out of the way, the one or more resistance bands 405 can be inserted into the resistance band block 355 in one action by placing the band terminator 410 behind the resistance band block 355 and allowing the one or more resistance bands 405 to lay into the indentations 395 provided for them. The retainer plate 360 can then be pivoted back into position and tightened down.

With respect to the above description, it is to be realized that the optimum dimensional relationship for the various components of the invention described above and in FIGS. 1 through 6C, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A wall-mountable exercise apparatus comprising:

a mounting subassembly, a pivot arm subassembly, and a user attachment subassembly;

wherein the wall-mountable exercise apparatus is adapted to allow a user to perform resistance exercises by pulling against one or more resistance bands;

wherein the user attachment subassembly is adapted to provide an attachment point between the wall-mountable exercise apparatus and a user's body;

wherein the pivot arm subassembly allows an angle of the resistance exercises to be changed;

wherein the mounting subassembly comprises a base plate and an angle adjustment subassembly;

wherein the base plate is a substantially flat and rectangular element for mounting to a wall;

wherein the base plate comprises two or more mounting holes through which fasteners are passed to secure the base plate to the wall;

wherein the angle adjustment subassembly comprises a first side plate, a second side plate, and a pivot axis;

wherein the first side plate and the second side plate are permanently attached to the base plate and are parallel to each other;

wherein the first side plate is separated from the second side plate by a distance at least as wide as an arm of the pivot arm subassembly;

wherein the pivot arm subassembly comprises the arm, a fork, a yoke, a swivel frame, a resistance band block, and a retainer plate;

wherein a first end of the pivot arm subassembly attaches to the mounting subassembly via a first end of the arm connecting to the pivot axis; wherein a second end of the arm forms the fork;

wherein the fork pivotally connects to the yoke;

wherein the connection between the fork and the yoke is held together by and allowed to pivot around a first yoke bolt;

wherein the swivel frame pivotally connects to another side of the yoke;

wherein the connection between the yoke and the swivel frame is held together by and allowed to pivot around a second yoke bolt;

wherein the first yoke bolt and the second yoke bolt are oriented perpendicular to each other;

wherein the swivel frame may pivot both up and down and side to side with respect to the arm.

2. The wall-mountable exercise apparatus according to claim 1 wherein the pivot arm subassembly attaches by a second end to the user attachment subassembly.

3. The wall-mountable exercise apparatus according to claim 2 wherein the angle adjustment subassembly allows the pivot arm subassembly to project from the mounting subassembly at an arm angle that will place the second end of the pivot arm subassembly at a low height, a high height, or at one or more heights between the low height and the high height;

wherein the angle adjustment subassembly is attached to a flat surface on the base plate between the two or more mounting holes.

4. The wall-mountable exercise apparatus according to claim 3 wherein a central hole in the first side plate allows the pivot axis to pass through the first side plate;

wherein a hole pattern in the first side plate forms a semicircle near an edge of the first side plate;

wherein the central hole and the hole pattern that appear on the first side plate also appear on the second side plate.

5. The wall-mountable exercise apparatus according to claim 4 wherein the pivot axis passes through the central hole of both the first side plate and the second side plate and through the first end of the arm;

wherein the arm pivots around the pivot axis.

6. The wall-mountable exercise apparatus according to claim 5 wherein an alignment hole in the arm lines up with portions of the hole pattern on both the first side plate and the second side plate, when the arm is moved to the arm angle corresponding to a hole in the hole pattern;

wherein once the arm is properly aligned, a locking pin is inserted into the first side plate and will pass through the arm via the alignment hole and the second side plate;

wherein the locking pin retains the arm at the arm angle as long as the locking pin is left in place.

7. The wall-mountable exercise apparatus according to claim 6 wherein the locking pin is a T-handle, quick release pin.

8. The wall-mountable exercise apparatus according to claim 7 wherein the swivel frame comprises a C-shaped portion;

wherein the resistance band block mounts to the swivel frame within the C-shaped portion of the swivel frame;

wherein the resistance band block is a rectangular block.

9. The wall-mountable exercise apparatus according to claim 8 wherein the resistance band block comprises indentations on one side to accommodate the one or more resistance bands;

wherein the retainer plate fastens to the one side of the resistance band block where the indentations exist;

wherein the retainer plate prevents the one or more resistance bands from lifting out of the indentations.

10. The wall-mountable exercise apparatus according to claim 9 wherein the retainer plate comprises a circular hole on one end and a slotted hole on another end;

wherein the retainer plate is held in place on the resistance band block by a first knob screw and a second knob screw;

wherein the first knob screw passes through the circular hole and into a first hole on the resistance band block;

wherein the second knob screw passes through the slotted hole and into a second hole on the resistance band block.

11. The wall-mountable exercise apparatus according to claim 10 wherein the user attachment subassembly comprises a user interface, the one or more resistance bands, and a band terminator;

wherein the one or more resistance bands comprise cords or tubes made from a stretchable material.

12. The wall-mountable exercise apparatus according to claim 11 wherein the one or more resistance bands are color-coded to indicate an amount of tension required to stretch the one or more resistance bands by a given distance.

13. The wall-mountable exercise apparatus according to claim 12 wherein the one or more resistance bands are connected between the user interface and the band terminator.

14. The wall-mountable exercise apparatus according to claim 13 wherein the band terminator comprises an endpoint for the one or more resistance bands and facilitates attachment of the user attachment subassembly to the resistance band block;

wherein facilitation of attachment of the user attachment subassembly involves inserting the band terminator into the resistance band block such that the one or more resistance bands lay into the indentations.

* * * * *